US005497553A

United States Patent [19]

Chong

[11] Patent Number: 5,497,553

[45] Date of Patent: Mar. 12, 1996

[54] SAFETY CUTTER

[75] Inventor: Sing-Yuen Chong, Chaiwan, Hong Kong

[73] Assignee: Twin Base Limited, Hong Kong

[21] Appl. No.: 284,217

[22] Filed: Aug. 2, 1994

[51] Int. Cl.[6] ..... B26B 1/08

[52] U.S. Cl. ..... 30/162; 30/320; 30/335

[58] Field of Search ..... 30/162, 320, 335, 30/337

[56] References Cited

U.S. PATENT DOCUMENTS

| | | | |
|---|---|---|---|
| 4,103,421 | 8/1978 | Quenot | 30/162 |
| 4,322,885 | 4/1982 | Osada | 30/162 |
| 4,794,693 | 1/1989 | Mayama et al. | 30/162 |
| 4,920,646 | 5/1990 | Grant | 30/335 X |
| 5,269,063 | 12/1993 | Okada | 30/162 |

FOREIGN PATENT DOCUMENTS

| | | | |
|---|---|---|---|
| 1522454 | 8/1978 | United Kingdom | 30/335 |

*Primary Examiner*—Eugenia Jones

*Attorney, Agent, or Firm*—Burns, Doane, Swecker & Mathis

[57] ABSTRACT

A safety cutter is provided to prevent un-actuated blade release. The cutter comprises a housing within which a slidable blade can be completely concealed. The blade is connected to a sliding member which controls blade movement in and out of the housing. A safety device is provided having a handle, a main plate and protuberances on the sides such that the sides of the safety device are complementary to the sides of an opening made on one surface of the cutter along which sides the sliding member is movable.

4 Claims, 4 Drawing Sheets

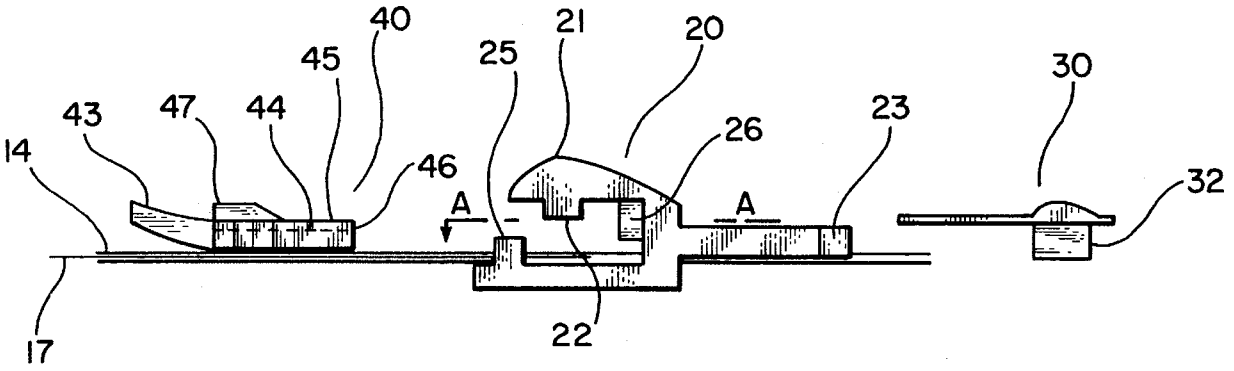
FIG. 3
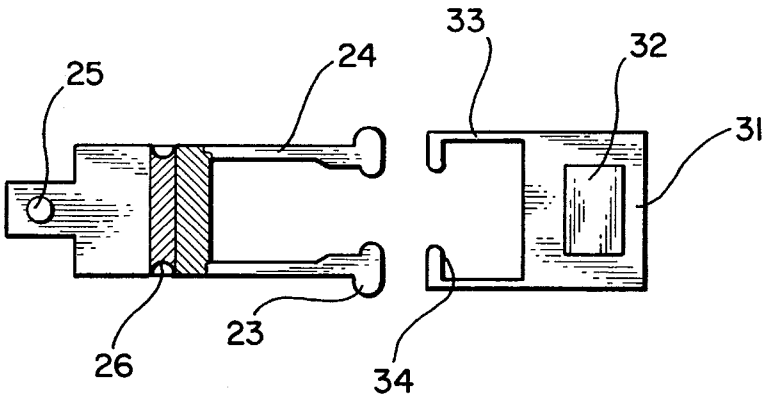
FIG. 6
FIG. 5
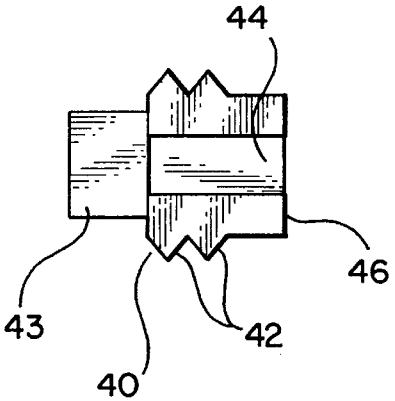
FIG. 4

SAFETY CUTTER

FIELD OF THE INVENTION

This invention relates to a safety cutter, in particular it relates to the type of simple hand-held cutter with a slidable blade which can be completely retracted and concealed inside a rigid housing when not in use. Usually, the retractable blade can be broken off at successive predetermined segments graduated on the surface of the blade.

BACKGROUND OF THE INVENTION AND PRIOR ART

Many types of hand-held cutters are known for cutting paper, cloth, vinyl or other soft materials. These cutters are useful for a variety of environments such as homes, schools, offices or factories for a variety of applications like pattern making, editing or artwork cut-and-paste. Among the hand-held cutters, there is a type which is particularly convenient, economical and therefore most commonly used. This type of hand-held cutter comprises a rigid housing with a large opening formed on one face. Inside the housing there is a provided a passageway which allows a retractable blade to move along the length of the housing. Movement of the blade is controlled by actuated movement, usually by the user's thumb, of a slidable member which connects with the blade by a hole-and-lug combination located near the end of the blade. The slidable member slidably engages with tracks on the edges of the opening such that it is allowed to move only along the length of the opening. The length of the portion of the blade protruding outside the housing is controlled by the slidable member which is set to be resisted and stopped at pre-defined intervals unless further actuated. Such positions are defined by notches or teeth located on at least one side of the opening above the tracks. Usually, the displacement between two successive notches equals the length of each blade segment which is usually graduated on the blade for easy break-away of the blunt portion of the blade.

After the sliding member is moved into a position thereby defining the length of the blade protruding from the housing, this position can be maintained by a wedging means which wedges the locking means of the sliding members to the notches on the sides of the openings.

When the cutter is not in use, the sliding member and the wedging means assembly forms a safety mechanism which is designed to prevent un-expected release of blade from the housing to prevent accidental cuts. If the blade is rusty, even very minor cuts can cause inflamation or tetanus. Every year, just in the United States alone, many paper cutter manufacturers have to deal with a large number of compensation claims made against them because of accidental cuts.

Such accidents frequently occur in places such as stationery shops or department stores, where the economical cutters are displayed in bulk without strong protective packaging so that customers can actually examine them and choose. The aforementioned safety means is not satisfactory especially after long-range transportation during which persistant vibrations may cause un-noticed unlocking of the locking assembly. Accidental cutting may also occur where curious children have access to cutters and accidentally unlock the locking assembly and actuate the sliding members thereby causing cuts. Such accidents may also happen to adults due to habitual tendency to push forward the sliding member while holding a cutter in hand. GB-2207073A discloses a safety cutter which incorporates a V-shaped spring locking member within a sliding member, such a cutter is more complicated, therefore more expensive, but would not offer actual solution to this safety problem as it would not prevent harm and damages due to persistent vibration, agitation among the non-individually packed cutters in transportation or subconscious habitual tendency of sliding member pushing by the thumb, thereby releasing blade. Further, repeated sliding of the spring on the plastic notches to which the spring also engages for locking will cause unnoticed wear of notches after repeated use and significantly hampers the engaging efficiency of the locking assembly.

SUMMARY OF THE INVENTION

It is an object of the present invention to provide a cutter which has a safety device to prevent personal injury because of accidental release of blade from the protective housing by the user or otherwise.

According to the present invention therefore there is provided a safety cutter, primarily for cutting paper or other non-rigid material, comprising a rigid housing with an elongated opening on one surface, recesses on at least one side of the elongated opening in the form of notches, a blade slidable inside the housing, said blade being completely retractable within the housing, sliding means for slidably moving said blade within said housing, wedging means for engaging said sliding means to limit movement thereof, and a safety means comprising a main plate portion, a handle, and at least one protuberance on at least one side of the main plate portion, said at least one protuberance being complementary with the recesses.

Preferably the safety means comprises a wedging means on the surface of the main plate portion, said wedging means being engageable with the sliding means.

Preferably the safety means comprises protuberances on two sides of the main plate, said protuberances being complementary with the aforementioned recesses on the sides of the elongated opening.

According to the present invention, there is therefore also provided a safety device for a cutter of the type comprising a housing with an elongated opening, said housing being provided with recesses on at least one side of the opening, a blade retractable within the housing, a sliding means and a wedging means, wherein the safety device comprises a main plate made of a rigid material, a handle for inserting and withdrawing the device, protuberances on at least one side of the main plate, said protuberances on the main plate being complementary with the recesses on the elongated opening.

BRIEF DESCRIPTION OF THE DRAWINGS

An embodiment of the invention will now be described by way of example and with reference to the accompanying drawings, in which:

FIG. 3 shows the side elevation of the safety means, sliding means and wedging means showing emphasis on the relative vertical level of the arrangement of the components not actually engaged with each other, FIG. 4 shows the view from underside of the safety means, FIG. 5 shows the view from topside of the sliding means with portion above level A—A removed, FIG. 6 shows the view from underside of the wedging means.

DETAILED DESCRIPTION OF THE PREFERRED EMBODIMENT

Figure 1:
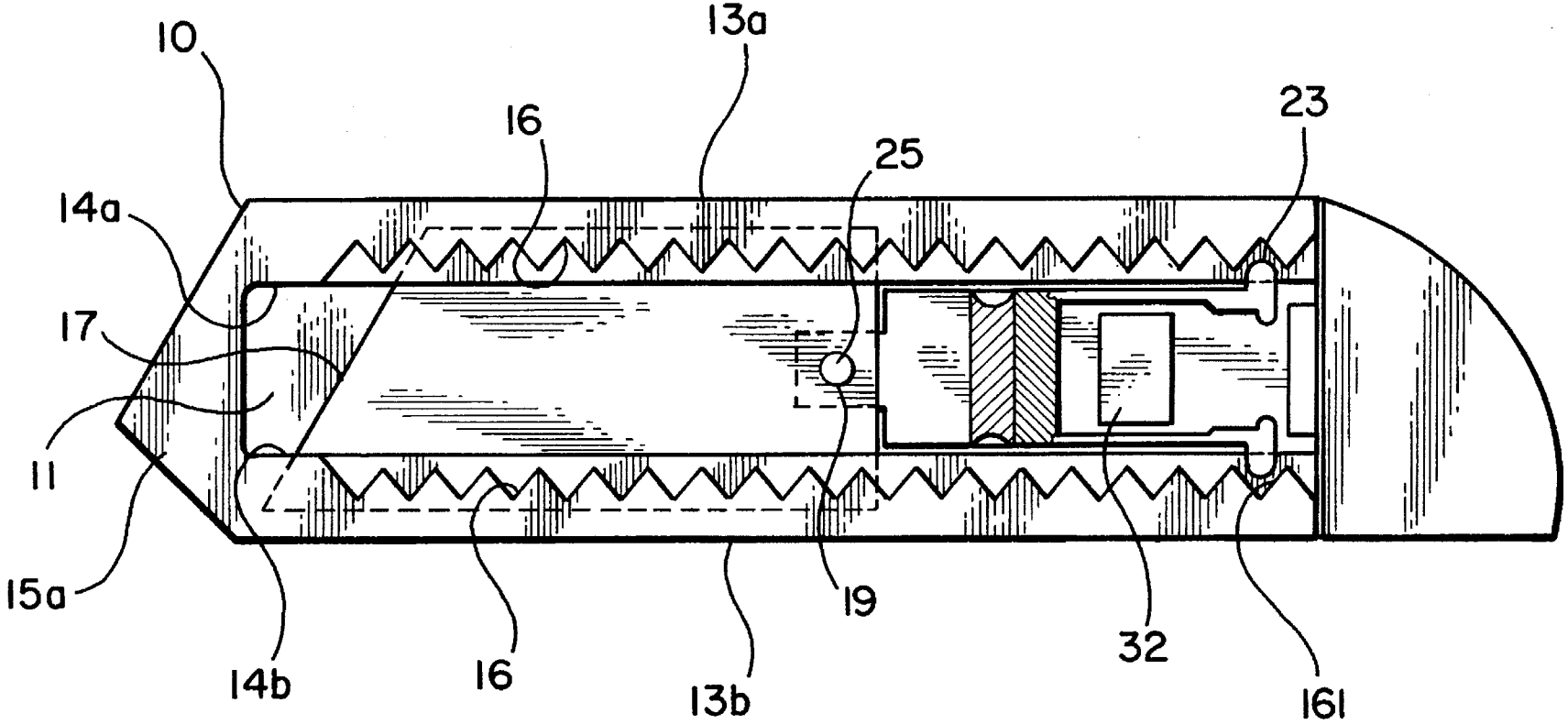
FIG. 1 shows the plan view of a cutter in the non-use state with the safety means and top part of the sliding means removed.

Referring to the figures, there is shown a cutter with a rigid housing 10, made of plastics or other rigid material, with an elongated opening 11 formed in one side of the housing 15*a*. On and along the long edges of opening 11 which are parallel to the edges 13*a* & 13*b* of the housing, there are provided tracks 14*a* & 14*b*. Said tracks are located at a level within the housing between the surfaces 15*a* & 15*b*. Along the tracks 14*a* and 14*b* there are provided a plurality of stopper recesses 16 in the form of V-shaped notches extending from the tracks 14*a* & 14*b* to one surface 15*a*. Naturally, notches of other shape can also be used. Between the other surface 15*b* and the tracks 14*a* & 14*b*, there is therefore formed a passageway such that a sharp blade 17, usually with breakable segments graduated on the blade surface, can be slidably moveable along the tracks 14*a* & 14*b*. At the front part of the housing 10, there is provided a slit opening 18 which permits passage of the front part of blade 17 in and out of the housing.

The movement of blade 17 is restrained by a sliding means 20, said sliding means has an actuating means 21 which resembles a canopy with a downwardly extending protrusion 22 near the front canopy edge and a pair of hooks 23 connected to resilient legs 24. On the rear end of blade 17 there is provided an opening 19 which can be coupled onto a blade engaging means 25 in the form of a lug on the sliding means 20. The blade 17 and sliding means 20 assembly can be locked in position by a wedging means 30, such a locking assembly should ideally prevent any blade movement unless actuated by the user.

Figure 2:
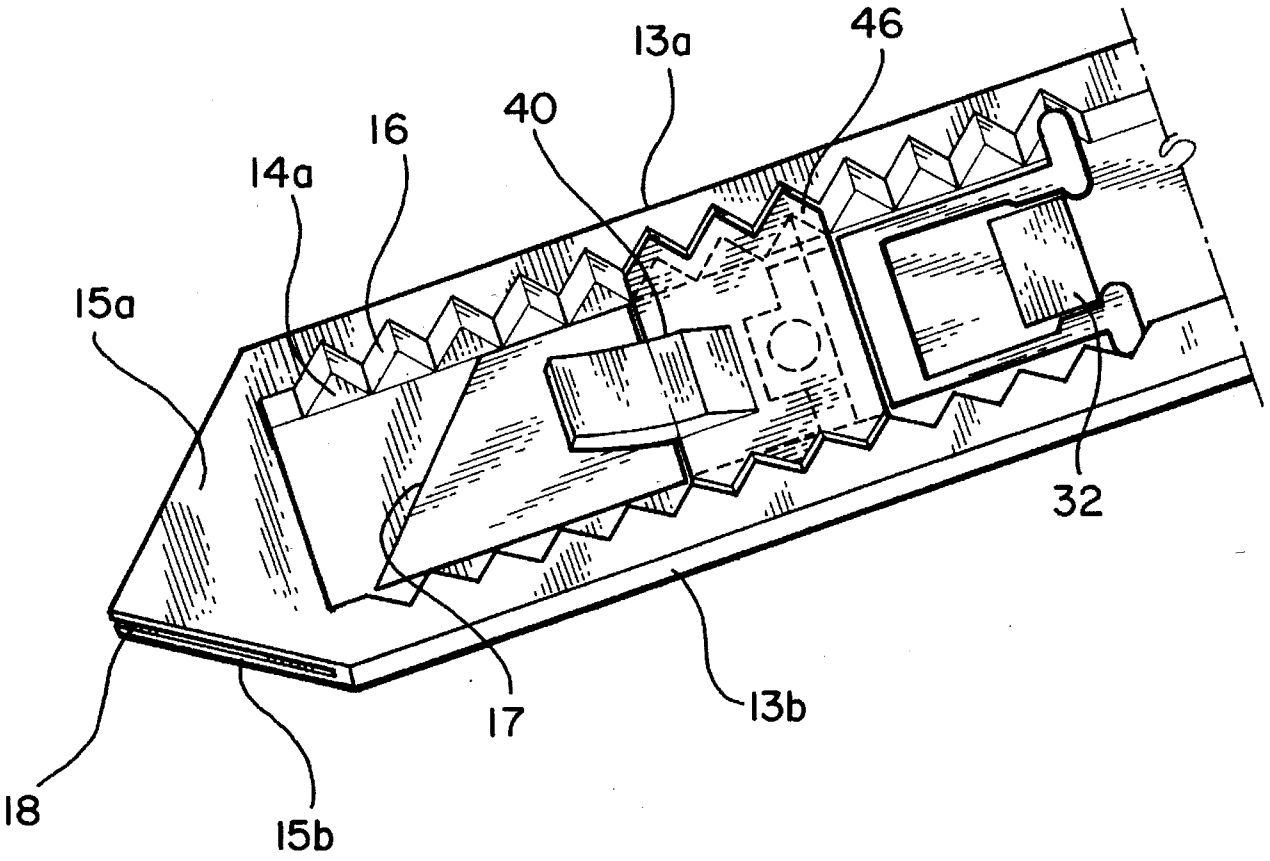
FIG. 2 shows a perspective view of the cutter with safety means and top part of sliding means removed.
Figure 7:
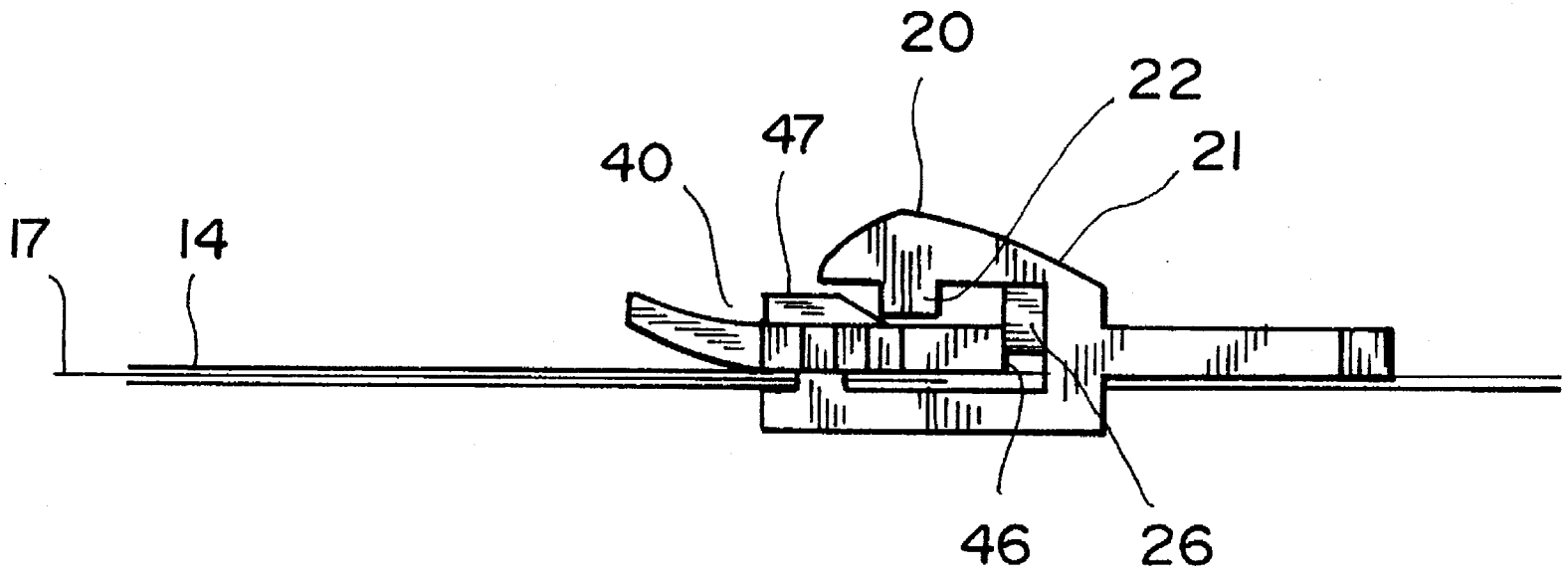
FIG. 7 shows the side view of the sliding means engaged with the safety means.

When not in use, the sharp portion of the blade 17 should be completely concealed within the housing 10 by locking the hooks 23 in the rightmost recess 16. Such locking is made possible by wedging means 30 which engages the sliding means at the narrower part of the leg opening (as shown in FIG. 2). The wedging means 30 comprises a main body 31, a wedging tenon 32 and a pair of resilient legs 33 with hooks 34 at the ends. The wedging means 30 maintains its wedged position by hooks 34 which clamp on to recess 26 on the sliding means 20. This locking mechanism, however, does not always perform up to expectation as it may be un-locked by a variety of reasons such as persistant vibrations in transit, manufacturing defects, accidental release by the user or inconsiderate acts of other people.

As can be seen from FIGS. 2 and 3, to prevent undesirable blade release, there is provided a safety means 40 which is made of plastics, wood, hard rubber or any suitable material as the housing. As shown in FIG. 4 the safety means 40 comprises a main block 45 with protuberances 42 on the sides, a handle 43 and a groove 44 on the underside to allow passage of blade-carrying lug 25. The thickness of the main block 45 is approximately equal to the distance between the tracks 14*a* & 14*b* and the surface 15*a*. The protuberances 42 on the main block 45 are complementary to the recesses 16. When the safety means 40 is properly placed inside the opening 11 such that tile protuberances 42 mate with recesses 16, any relative movement between the safety means 40 and the cutter housing 10 is prohibited. Movement of the sliding means 20 which carries the blade 17 towards the slit opening 18 is therefore also prohibited because of its direct physical contact with the edge 46 of the safety means 40. On the top face of the main plate 45 of the safety means 40 there is further provided a wedge-shaped member 47 such that, when the sliding member 20 engages with the safety means 40, the protrusion 22 and the wedged-shaped member 47 are wedgingly engaged thereby preventing the safety means from falling out of position due to vibrations or other reasons which could otherwise be tile cause of release of the safety means 40 from its engaged position. To release the safety means, the user simply lifts the handle 43 until the main plate 45 is in a tilting position which allows removal of tile safety means without undue difficulty.

For cutters according to the present embodiment, accidental blade release is virtually impossible and further, the maximum length of blade extending outside the housing 10 is absolutely limited by placing the safety means 40 along the length of the tracks 14*a* & 14*b* thereby setting the maximum possible blade extension.

As an alternative modification to the present embodiment, there can be provided a cutter with a housing 10 which has notches or recesses 16 on only one side of the elongated opening 11, the safety means 40 is therefore modified accordingly such that protuberances 42 are provided on one side of the safety means 40 such that the resulting safety means is complementary to the non-notched edge of the opening 11.

While the invention has been described with respect to a preferred embodiment, it will be appreciated that many other variations, modifications and applications of the invention may be made.

I claim:

1. A safety cutter, comprising:

a rigid housing with an elongated opening on one surface, recesses on at least one side of said elongated opening in the form of notches, a blade slidable inside the housing, said blade being completely retractable within the housing, sliding means which engages said blade for slidably moving said blade within said housing, wedging means for engaging said sliding means to limit movement thereof, and a safety means insertable within said elongated opening to contact said sliding means and thereby limit its movement, said saftey means comprising a main plate portion, a handle, and at least one protuberance on at least one side of the main plate portion, said at least one protuberance being complementary with said recesses for engagement therein.

2. A cutter according to claim 1 wherein:

the safety means comprises second wedging means on a surface of the main plate portion, said second wedging means being engageable with said sliding means.

3. A cutter according to claim 2 wherein said recesses are located on two sides of said elongated opening, and said at least one protuberance of said safety means comprises protuberances on two sides of the main plate portion, said protuberances being complementary with said recesses on the sides of the elongated opening.

4. A cutter according to claim 1 wherein:

the sliding means comprises a base plate, an elongated member extending from said base plate, and a protuberance at an end of said elongated member, said protuberance being engageable with said recesses located on at least one side of the elongated opening.

* * * * *